United States Patent [19]

Wadensten

[11] 3,938,905

[45] *Feb. 17, 1976

[54] NOISELESS AIR-ACTUATED TURBINE-TYPE VIBRATOR WITH MUFFLER

[76] Inventor: Theodore S. Wadensten, P.O. Box 8 Stilson Road, Wyoming, R.I. 02898

[ * ] Notice: The portion of the term of this patent subsequent to Mar. 11, 1992, has been disclaimed.

[22] Filed: Jan. 2, 1974

[21] Appl. No.: 430,082

[52] U.S. Cl. ..... 415/119; 415/92; 259/DIG. 43

[51] Int. Cl.[2] ..... F01D 5/12

[58] Field of Search ..... 259/DIG. 43; 415/119, 202, 415/213 T, 503, 92

[56] References Cited

UNITED STATES PATENTS

| | | | |
|---|---|---|---|
| 2,518,869 | 8/1950 | Corless | 415/119 X |
| 2,793,009 | 5/1957 | Peterson | 259/DIG. 43 |
| 2,875,988 | 3/1959 | Wysong | 259/DIG. 43 |
| 2,917,290 | 12/1959 | Peterson | 259/DIG. 43 |
| 3,074,151 | 1/1963 | Kroeckel | 29/156.8 |

*Primary Examiner*—Houston S. Bell, Jr.
*Assistant Examiner*—Michael H. Thaler
*Attorney, Agent, or Firm*—Ralph R. Roberts

[57] ABSTRACT

This invention pertains to an air-actuated vibrator of the turbine-type in which the rotor and enclosing chamber is contoured so as to provide within the normal operating range a low noise level which is below 80 db (hertz). In association with this chamber is a novel muffler which receives the output from the chamber and reduces the noise level to about 65 db or less which is much below the tolerance level established as acceptable. The rotor is the only moving part in this vibrator and has its periphery formed with small tooth-like transverse serrations but other similar profiles may be used. The tooth profile is of such small size that the driven rotor which is peripherally driven by pressurized air within a normal supply range produces noise levels which are sufficiently low so that the operation of the vibrator in combination with the associated muffler is considered to be virtually silent.

12 Claims, 6 Drawing Figures

NOISELESS AIR-ACTUATED TURBINE-TYPE VIBRATOR WITH MUFFLER

CROSS-REFERENCE TO RELATED APPLICATION

This invention pertains to and includes by reference my U.S. patent application Ser. No. 355,681, now U.S. Pat. No. 3,870,282, filed on Apr. 30, 1973 and entitled, "Noiseless Air Actuated Turbine-Type Vibrator".

BACKGROUND OF THE INVENTION

1. Field of the Invention

In accordance with the classification of art as established by the United States Patent Office this invention is found in the general Class entitled, "Agitating" (Class 259) and the subclass therein entitled, "miscellaneous" (subclass 1) which has been further indentified in this subclass as "1R" and "DIG. 43". The method of making a vibration apparatus as in the embodiment shown is found in the general Class entitled, "Metal Working" (Class 29) and the subclass therein of "impellers" (subclass 156.8).

2. Description of the Prior Art

Air turbines are not new and making the rotor with an eccentric weight is also well known as seen in U.S. Pat. No. 3,074,151 to KROECKEL as issued on Jan. 22, 1963. Another patent using the same general concept includes U.S. Pat. No. 2,875,988 to WYSONG as issued on Mar. 3, 1959. Other air driven vibrators also generally used include ball-type vibrators as seen in U.S. Pat. Nos. to PETERSON, No. 2,793,009 as issued on May 21, 1957 and 2,917,290 as issued on Dec. 15, 1959. In the above apparatus as well as others known to the applicant the noise levels exceed the tolerance levels for continuous duty operation (ie. 85 db) as established by the Federal Occupational Safety and Health Act of 1970.

The turbine-type pneumatic vibrator of this invention, as reduced to practice and extensively tested and used in commercial installations, operates substantially continuously at noise levels well below the established 85 db and with the associated muffler operates at levels of 60 to 70 db. This, of course, falls well within the safety limits of the federal standard. In sharp contrast to this "quiet" vibrator is the ball-and-race vibrator now and for the past several years in extensive use. This ball-and-race vibrator is shown and described in U.S. Pat. Nos. 2,793,009 as issued on May 21, 1957 and 2,917,290 as issued on Dec. 15, 1959 both to PETERSON. The noise level usually found in the installations of these ball-and-race vibrators is often in excess of 100 db. This noise level for periods of 8 or more hours, of course, is unacceptable.

In the present invention the size of the rotor, the number and depth of teeth used therewith and the normal operating range of air pressure used to drive the vibrator are closely related factors. The air turbine vibrator of this invention uses a close limit control of these factors to successfully exceed the safe requirements for a "quiet" operation of the vibration apparatus.

SUMMARY OF THE INVENTION

The present invention may be summarized at least in part with reference to its objects.

It is an object of this invention to provide, and it does provide, an air-actuated turbine-type vibrator in which the eccentrically weighted rotor has its periphery formed with a regular pattern and spacing of small saw-tooth forms. These tooth forms of a determined size and configuration commensurate with the size of the rotor. The discharge from the chamber is ninety degrees from the inlet and is through a side wall of the chamber and then an associated muffler.

It is a further object of this invention to provide, and it does provide, an air-actuated turbine-type vibrator in which the air inlet is of a size which is proportioned as to the diameter of the rotor. The outlet is also proportioned as to the diameter of the rotor and is through a side wall of the chamber and an associated muffler. The ratio of the inlet to the outlet diameter of the smaller diameter vibrators is about 40 percent of the outlet diameter whereas in the large diameter rotors the ratio of the inlet to the outlet is about 50 percent.

The air-actuated turbine-type vibrator of this invention, as reduced to practice, ranges from a rotor diameter of 1⅜ inches to a diameter of five inches and the number of saw teeth carried by the rotor range from 50 to 100 teeth. The groove depth of the saw-tooth on the various diameter rotors ranges from 1/32 to ¼ of an inch depending upon the diameter of the wheel. The air turbine of this invention includes a standard circumferential chamber in which the outlet is disposed about ninety degress from the inlet and through the side wall of the chamber. In the various size units the inlet and outlet sizes vary. The outlet may be one or more holes in the side wall of the chamber, these holes leading directly to a muffler associated with the housing. The threaded portion of the inlet terminates at about one-eighth to 5/16 of an inch depending on size of the unit. The unthreaded portion creates a venturi action prior to the inlet entering the peripheral path of the turbine wheel. The inlet of the silent turbine is of a smaller diameter than is the outlet. The turbine has an eccentric weighted rotor and the eccentric weight is selected as to the amount of vibratory force to be exerted. The teeth are formed on the periphery and are generally transverse to the axis of the rotor and in many instances are saw-tooth in form. The number of teeth on the rotor is carefully calculated and in actual tests provides the lowest db noise level achievement while providing high r.p.m. output. The air-actuated turbine-type vibrator is contemplated to operate at air pressure ranging from 30 to 110 p.s.i.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen a specific embodiment for the "noiseless", air-actuated turbine-type vibrator as adopted for use with inlet air pressure of 30 to 110 p.s.i. and showing a preferred means for the construction of the turbine chamber and the tooth profile formed on the periphery of the rotor. This specific embodiment and an alternate embodiment have been chosen for the purposes of illustration and description as shown in the accompanying drawings wherein:

Figures 1, 2, 3:
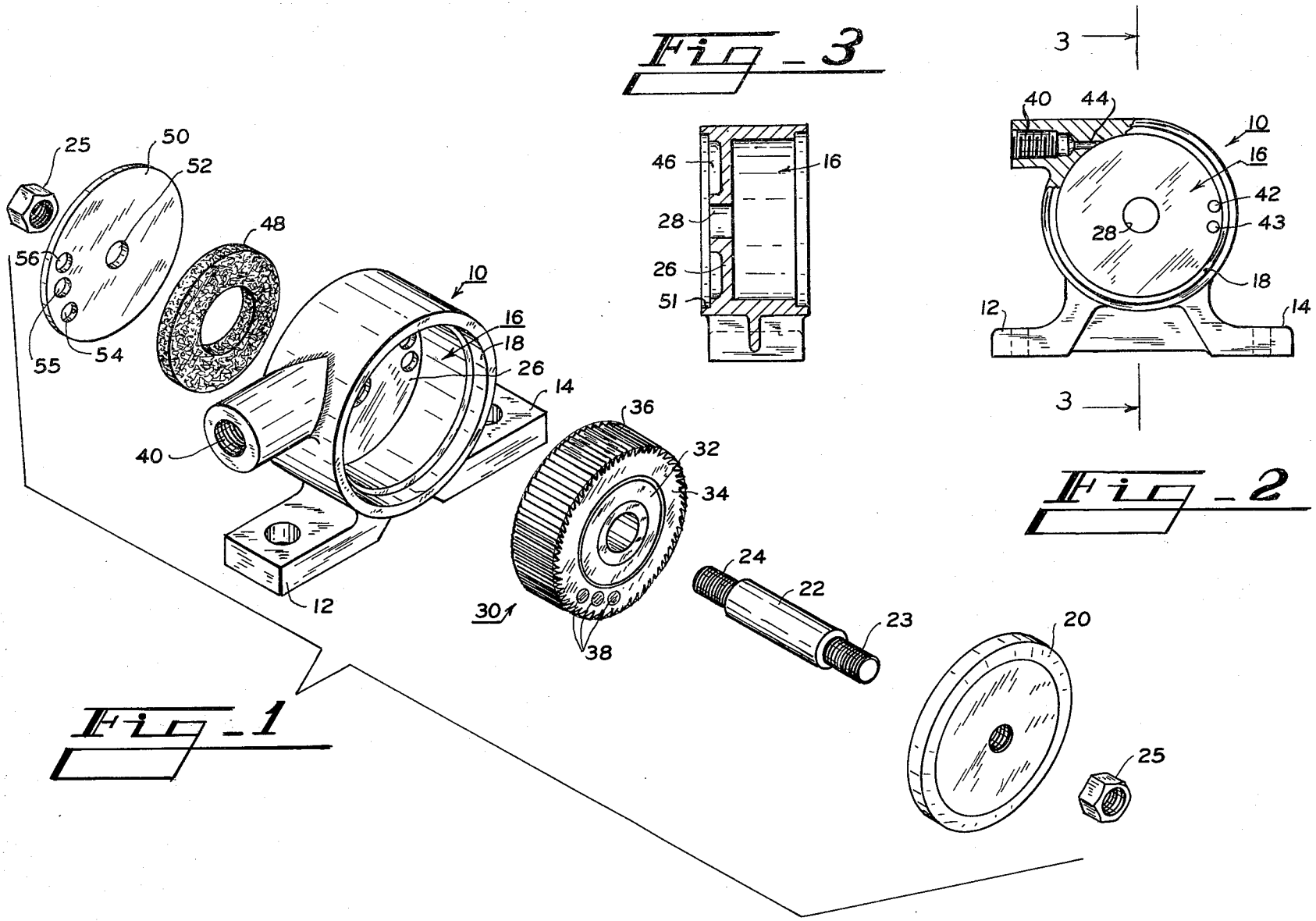
FIG. 1 represents an exploded isometric view showing in general detail the construction and relationship of the components which comprise the air turbine vibrator and associated muffler.
FIG. 2 represents a side view of the housing of FIG. 1 and fragmentarily in section showing the inlet portion of the housing.
FIG. 3 represents a transverse sectional view of the housing of FIG. 2, the view taken on the line 3—3 thereof and looking in the direction of the arrows.

In the following description and in the claims various details will be identified by specific names for convenience; these names, however, are intended to be generic in their application. Corresponding reference characters refer to like members throughout the figures showing the construction of the turbine-type vibrator and in the charts and graphs used therewith.

The drawings and charts accompanying, and forming part of, this specification disclose certain details of construction for the purpose of explanation of the invention, but it should be understood that structural details may be modified in various respects without departure from the concept and principles of the invention and that the turbine-type vibrator may be incorporated in other structural forms than shown.

Description of the Embodiment of FIGS. 1–3

Referring now in particular to the drawings there is shown in FIG. 1 an isometric exploded view of the preferred construction of an air turbine vibrator of this invention. This vibrator includes a housing generally designated as 10 and having a base adapted for mounting onto a flat surface. This base includes leg portions 12 and 14 and above and between these portions is provided a chamber portion 16 which is circular in configuration and of a determined depth. This chamber has formed outwardly and on the near side an outer larger circular recess 18 adapted to receive and retain a disc-like end 20 which has mounted to it an axle 22. This axle includes a near threaded portion 23 and at its left or distal end a threaded portion 24, both threaded portions adapted to receive and be retained by a nut 25. A back wall 26 is formed in the housing and closes off the rear portion of the chamber area 16. This back wall is formed with a hole 28 providing a passage therethrough for the axle member 22.

Adapted for mounting on the axle 22 is a rotor generally designated as 30. This rotor includes a ball bearing 32 which provides the antifriction bearing portion around which the rotor is driven. Around this ball bearing 32 is a rotor portion 34 which has formed on the outer periphery thereof teeth 36 whose size and spacing is essential in the quiet operation of the turbine. Between the bearing 32 and the outer tooth portion 36 there is mounted in the rotor portion 34 heavier elements in the form of dowels or rods and generally identified as 38. These heavier elements may be of steel, sintered heavy metal, lead or the like. These rods are mounted as by a press fit or by threaded retention into previously prepared holes in the rotor portion 34 which is usually a die casting or machined part of zinc or aluminum. It is to be noted that the rotor need not be limited to metal as plastic may also be used. Since the air being fed into the turbine often carries impurities with it in the form of rust, scale or dust the use of a plastic for the rotor may or may not be feasible depending upon the environment in which it is used. However, it is to be contemplated that the scope of this invention includes the use of plastics and the like for both the rotor and the housing.

Referring now to FIGS. 1, 2 and 3, there is depicted a preferred housing construction for guiding pressurized air to and from the chamber portion 16. An inlet 40 has a reduced diameter inner portion and an outer threaded portion for mounting a threaded nipple therein. This thread is of a selected size to accommodate the pipe conduit not shown. Outlet holes 42 and 43 are drilled holes whose combined area is 1½ to 5 times the area of reduced diameter 44 leading from the threaded portion to chamber 16. This reduced inlet is disposed and sized to provide a jet force with this reduced diameter concentrating the incoming air as a tangential impinging force on the teeth of the rotor. This short length 44 ranges from ⅛ to ½ of an inch in length depending on the size of rotor and chamber.

About 90° clockwise from the reduced inlet 44, as seen in FIG. 2, are outlet holes 42 and 43 which are closely adjacent the outer wall of the chamber 16. These holes pass through wall 26 into a shallow annular recess 46 formed on the left side of wall 26 as in FIG. 3. In this recess is removably mounted a porous filter member 48 which, as the muffler pad, is shaped in the form of a washer. A closing plate 50 has its outer diameter sized to mount in annular outer groove 51 in housing 10. A hole 52 is sized to slidably mount on the threaded portion 24 of axle 22. Holes 54, 55 and 56 are drilled through plate 50 and when plate 50 is in mounted condition are at or close to the outer diameter of recess 46. In mounted condition the holes 54, 55 and 56, as depicted, are diametrically opposite the holes 42 and 43 in side wall 26. Nut 25 secures plate 50 in recess 51 as well as the pad 48 in recess 46.

Assembly of the Vibrating Turbine of FIG. 1

The chamber 16 is of a determined size which, as reduced to practice, is substantially the diameter of the rotor and may be from 1⅜ inches to 5 inches in diameter. The weights 38 placed in the rotor portion 34 may be light, medium, or heavy depending upon the effective vibratory force exerted at the desired operating conditions of the unit. One or more ball bearings 32 are assembled in the rotor 34 as a press fit in a bore formed therein. This assembly 30 is then pressed as a snug fit on the smooth mid-shank portion of shaft 22 after which the disc end 20 and the shaft mounted rotor are then pushed into bore 16 of the housing 10. The periphery of the tooth portion 36 provides a clearance of a few thousandths of an inch to ⅛ of an inch between the outer periphery of the teeth and the inner surface of bore 16. The threaded end portion 24 of axle 22 is passed through the hole 28 and with nut 25 tightened the muffler pad and plate 50 are retained in mounted condition on the left side of the housing 10. End 20 is seated into recess 18 and with the nut 25 mounted and tightened on threaded end 23 the unit is assembled.

The effectiveness of this vibrator as far as operating at or below a safe noise level results from a careful forming of the teeth portion 36 preferably in the manner of a saw-tooth form. The relationship of this tooth form and the pressurized air fed through the inlet portion 44 of the inlet is selected so that the vibrator will operate at maximum r.p.m.'s with a noise level below seventy db's and preferably in the range of 60 to 65 db's or less, which level is less than the established level permitted where continuous presence of workmen in or around these vibrators may occur without damage to their hearing.

Figures 4, 5, 6:
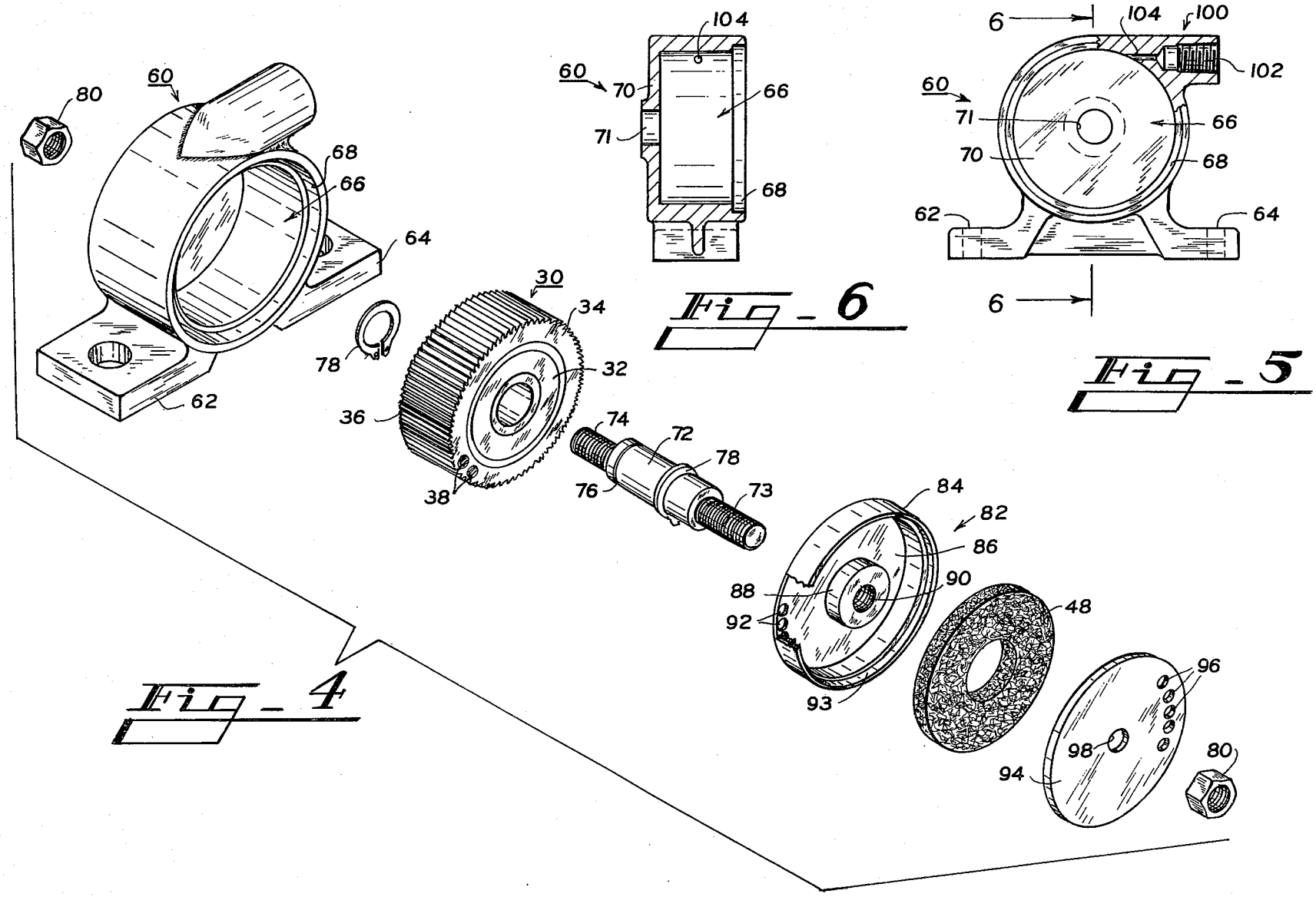
FIG. 4 represents an exploded isometric view of a vibrator assembly which is an alternate construction to the embodiment of FIG. 1, this view showing in general detail the construction and relationship of the several components.
FIG. 5 represents a side view of the housing of FIG. 4 and fragmentarily in section showing the inlet portion of the housing.
FIG. 6 represents a transverse sectional view of the housing of FIG. 5, this view taken on the line 6—6 thereof and looking in the direction of the arrows.

Description of the vibrator of FIG. 4

Referring next to the embodiment as shown in FIG. 4, there is depicted a noiseless vibrator similar in most respects to the embodiment of FIG. 1 except that the muffler is positioned on the near side which is opposite that shown in FIG. 1. As depicted, a housing generally designated as 60 is like housing 10 except for the forming of the back wall. The base has legs 62 and 64 and above and between these legs is chamber portion 66 which is circular in configuration and of a determined depth. On the near or open side of this chamber is formed a shoulder recess 68 which is adapted to receive and retain a closing cover assembly which includes the muffler, to be hereinafter more fully described. A back wall 70 has an axle retaining hole 71 formed therein.

An axle 72 has a smooth diameter midportion and near and far threaded ends 73 and 74. A pair of snap ring grooves 76 is adapted to each receive a snap ring 78. Adapted for mounting on the midportion of axle 70 is a rotor 30 as in FIG. 1. This rotor is also carried on a pair of ball bearings 32 which provide antifriction bearing properties and around which the rotor is driven. Rotor portion 34 has saw teeth 36 formed on its outer periphery. In rotor portion 34 is mounted the weight members 38.

The near end of chamber 66 is closed by a cup-shaped end member generally identified as 82 and having a circumferential band or rim 84 attached to and extending from an end wall 86. A hub 88 having an aperture 90 therethrough is adapted for mounting on the near end of axle 72. A plurality of holes 92 is formed through end wall 86 and as viewed through the broken away portion of rim 84 lays immediately adjacent the inner surface of the rim. The broken away portion of rim 84 is only for the purpose of illustration as in practice this rim is unbroken. A washer-shaped porous muffler pad 48 is adapted for mounting in the annual recess between hub 88 and rim 84. A receiving and retaining shoulder or counter bore 93 is formed at the near or outer edge of rim 84 and is sized so as to receive and seat end disc 94. A plurality of holes 96 is formed in this disc and is disposed to lay adjacent the inner wall of rim 84 when the disc 94 is mounted in counter bore 93. A hole 98 is disposed to permit passage of the threaded end 73 and axle 72 therethrough.

An inlet 100 has a threaded portion 102 and a reduced diameter portion 104. The threaded portion is for securing a threaded nipple therein while the reduced diameter portion is disposed and sized to provide a jet force with this reduced diameter disposed and arranged to concentrate and direct the incoming pressurized air as a tangential impinging force on the teeth 36 of the rotor. The sizes of this inlet correspond to the sizes of the inlet described in detail in my reference application. The area of outlet holes 92 are equal to and preferably exceeds the corresponding outlet area of the discharge ports in the reference application. The combined area of holes 92 is less than the combined area of the final exit holes 96 in disc 94.

Assembly of the Vibrating Turbine of FIG. 4

The diameter of the chamber 66 is a few thousandths to one-eighth inch larger than the diameter of rotor 30 which may be from 1⅜ inches to 5 inches in diameter. Weights 38 are a matter of selection depending upon the desired vibratory force to be exerted. One or more ball bearings 32 are assembled in the rotor as a press fit in the bore of portion 34. This assembly is then pressed onto the smooth central portion of axle 72. Snap rings 78 are mounted in grooves 76 to position and retain the rotor assembly longitudinally on the axle 72.

This assembly is now mounted in housing 60 with the threaded end 74 of axle 72 being passed through hole 71 and by means of nut 80 the rotor is secured to housing wall 70. The cup-shaped end member 82 is now readied for mounting on the axle 72 and in shoulder recess 68. As depicted in FIG. 4, member 82 is oriented so that the holes 92 in wall 86 are disposed at a position which is about ninety degrees radially counterclockwise from the inner discharge end of reduced diameter inlet portion 104. As thus oriented the end member 82 is slid onto axle 72 and into seated condition in recess 68. The muffler pad 48 is now mounted in the outwardly facing recess of member 82. End disc 94 is next mounted on extending threaded end 73 of axle 72 and holes 96 are disposed diametrically opposite the holes 92 in member 82. This 180° orientation of the final outlet holes 96 from exhaust holes 92 provides the longest discharge flow path through filter pad 48. Nut 80 is now mounted on and is tightened on threaded end 73. The tightened nuts 80 retain the assembly in the desired operating condition.

Operative Improvement

In the several charts of the operation of the embodiment shown in my above-reference application, Ser. No. 355,681, the decibel ratings as in the chart of FIG. 3 of that application as compared to the performance of the embodiment of the present invention, have resulted in a drop of about ten percent from the charted decibel level in that found in the muffled vibrator of this application. The range of model 100 in the present embodiment is a noise level in the low fifties to about 65 and in the larger model 250 in a noise level of a decibel range of less than 60 to a high of 65 to 67 decibels. All tests were made with saw-tooth shaped tooth profiles with pitches on the large rotor of a coarse size of 24 pitch to a fine size tooth profile of 48 pitch on the small rotors. In addition to reducing the air flow pathway in the chamber of the present invention to a quarter revolution, it is believed that the devious flow path through the muffler and the use of plural holes reduces the resonant chamber effect. Comparative tests with the reference embodiment to the instant embodiments reveal that the saw-tooth profile rotor produces substantially equal r.p.m.'s at comparable inlet pressures and that the noise level of the instant embodiments is distinctly lower than the embodiment in the reference application where the influent air travel path in the chamber is slightly more than 180°.

In the above-described embodiments the description has been directed to the various components as shown, however, many alternate constructions are available. Among these alternate constructions is the placement of the inlet and outlet holes into and from the muffler chamber. These holes may be moved toward the axis of the rotor, if desired, and the muffler chamber need not be made circular. The circular chamber depicted is essentially a matter of aesthetics and economy. The muffler pad is also a matter of filling the chamber cavity and need not be a wafer except where construction dictates. The relationship of the inlet to the outlet need not be diametrically opposite but may be oriented at other angles. Such orientation alternates, of course, reduce the length of the flow path through the mufflers thus reducing its noise reducing ability.

Although snap rings 78 are shown in FIG. 4 that is not to limit the vibrator construction thereto. For example, spacers may be used as well as forming inwardly directed bosses on the end walls and closure plates. It is also to be noted that two muffler chambers may be provided on the same vibrator if and when desired. For example, the unit of FIG. 1 instead of plate 20 might use the members 82 and 94 and filter 48 to close the near side and thus with chamber 46 provides dual mufflers and muffler chambers.

It is, of course, realized that the holes 42 and 43 of the embodiment of FIG. 1 and holes 92 of the embodiment of FIG. 4 could be located in a boss-type outlet formed as a part of the radial wall of the housing. This outlet would also be about 90° radially downstream from the inlet. This wall outlet would then be connected so that effluent stream would flow through a longitudinal muffler or, if desired, a washer-type muffler as in one of the depicted embodiments. It has been found that increasing the radial orientation of the discharge outlet from the inlet does not appreciably increase the decibel noise but an increase does reduce the r.p.m. output of the rotor. The tooth profiles of the reference application may be used but with some profiles the speed of the rotor is slightly reduced. The noise levels remain about the same when using the saw-tooth rotor as with other profiled rotors of the same diameter and at the same input pressure.

The gear tooth design of the reference application and with 24 pitch is the design used on the rotor in the commercial 5 inch vibrator model of this invention. Of course, the vibrator of this invention cannot be used in certain food or pharmaceutical manufacturing systems where direct air discharge into the manufacturing environment is not permitted.

Terms such as "left", "right", "up", "down", "bottom", "top", "front", "back", "in", "out", "clockwise", "counterclockwise" and the like are applicable to the embodiments shown and described in conjunction with the drawings. These terms are merely for the purpose of description and do not necessarily apply to the position in which the noiseless turbine-type vibrator with muffler may be constructed or used.

While a particular embodiment of these vibrators has been shown and described it is to be understood that modifications may be made within the scope of the accompanying claims and protection is sought to the broadest extent the prior art allows.

What is claimed is:

1. A relatively silent, compressed gas-actuated, turbine-type vibrator having a rotor of not less than 1-1/4 inches and not more than 5½ inches diameter and when operated within a speed range of 6,000 to 10,000 rpms having a noise level not greater than 75 decibels hz., the vibrator including: (a) a substantially closed housing having a cylindrical chamber therein; (b) a dynamically unbalanced rotor freely rotatable in the cylindrical bore of the chamber, the diameter and length of the rotor being established so that not less than 1/32 of an inch clearance is provided between the rotor and ends and bore of the chamber, the rotor having a plurality of tooth-like configurations formed on its outer periphery, the tooth-like configuration further having a depth which corresponds to a distance not exceeding 7 percent and not less than 1½ percent of the diameter of the rotor; (c) an air outlet formed in the housing and extending from the rotor chamber to the outside of the housing; (d) an air inlet formed in the housing and extending from the outside of the housing to the rotor chamber, the air inlet arranged to direct the incoming pressurized air tangentially against the teeth of the mounted rotor and with the tooth-like configuration so formed that in a plane normal to the axis of the rotor the face of the tooth-like configuration against which the incoming air impinges defining an angle of intersection with a theoretical radial line of said rotor, said defined angle being as little as zero and as great as 30° as measured from said point of intersection and inclined in such a direction that the circumferential thickness of the tooth-like configurations tend to decrease as the radial distance from the axis increases, the cross-sectional area of the inlet being 30 to 55 percent of the area of the outlet diameter; (e) a muffler housing carried by the turbine housing and providing an attached muffler chamber, said muffler housing having an inlet side connected to the chamber outlet and on a side opposite the inlet side into the muffler housing there is provided a closure plate having an outlet leading substantially directly to atmosphere, and (f) a porous muffler member carried in the muffler housing, this muffler member constructed so as to provide myriad paths for the effluent air while flowing through the muffler housing to its discharge from this muffler housing.

2. A turbine-type vibrator as in claim 1 in which the rotor is provided with saw-tooth formed teeth ranging in size from 48 to 24 diametral pitch on rotors whose outer diameters range from 1⅜ inches to 5 inches.

3. A turbine-type vibrator as in claim 1 in which the length of the controlling inlet size is between ⅛ and ½ inch and the diameter of the inlet is between 1/10 and ¼ inch.

4. A turbine-type vibrator as in claim 1 in which the closure plate is a disc and the axle is passed therethrough, the disc adapted to snugly engage a mating positioning means formed at the opening of the muffler housing to provide a seat for the disc and an end closing of the muffler housing and in which the back wall of the rotor housing has an aperture sized to receive and retain the axle which is passed therethrough and by a fastening means the axle and attached disc is tightly drawn into a closing condition of the chamber, the back wall of the rotor housing having at least one outlet hole and on the opposite side is provided said muffler housing which is mounted thereon and when secured to the vibrator housing retains said porous muffler member therein.

5. A turbine-type vibrator as in claim 4 in which the muffler housing is cup-shaped and the muffler member is washer-shaped, the retaining of the housing to the vibrator housing being achieved by a nut removably mounted on and tightened on an extending threaded end of the axle.

6. A turbine-type vibrator as in claim 5 in which the outlet hole through the end wall is disposed approximately ninety degrees downstream from the inlet in the rotor chamber and the outlet hole from the muffler housing is at least one hole in the side wall of this muffler housing.

7. A turbine-type vibrator as in claim 1 in which the rotor chamber has an open side which is closed by said cup-shaped muffler housing adapted to be seated in the outer end of the rotor chamber, the cup-shaped muffler housing having at least one air passage hole formed in side wall portion thereof, this air passage hole providing the inlet for the air discharge through the muffler, and said closing end plate adapted for covering the open side of muffler housing, this closing end plate having at least one outlet air hole formed therethrough and in mounted condition providing a discharge passageway for the discharges of the effluent air.

8. A turbine-type vibrator as in claim 7 in which the cup-shaped muffler housing has its side wall formed with a passageway sized to slide on an extending end of the axle and the closing end plate is also formed with a passageway sized to slide on the same extending end of the axle, this end of the axle being threaded sufficiently to removably retain a nut which is tightened thereon to retain the muffler housing and closing end plate in mounted condition.

9. A turbine-type vibrator as in claim 8 in which the air passage in the muffler housing side wall is a plurality of holes positioned in the side wall so that in mounted condition they lay adjacent the circular wall of the rotor bore, and the outlet in the closing end plate is a plurality of holes so positioned that in mounted condition they lay adjacent the inner surface of an outer rim portion of the cup-shaped muffler housing.

10. A turbine-type vibrator as in claim 9 in which the outer rim of the muffler housing is generally circular in configuration and the porous muffler is washer-shaped.

11. A turbine-type vibrator as in claim 1 in which rotors of 1¼ inches in diameter to and including 3½ inches in diameter have not less than 40 teeth and more than 80 teeth, and rotors of 3¾ inches in diameter to and including 5 inches in diameter have not less than 60 teeth and more than 120 teeth.

12. A turbine-type vibrator as in claim 1 in which the teeth on the rotor are arranged to lay in a plane passing through the axis of the rotor.

* * * * *